US006503095B1

(12) United States Patent
Endo et al.

(10) Patent No.: US 6,503,095 B1
(45) Date of Patent: Jan. 7, 2003

(54) TERMINAL LUG AND WIRING BOARD PROVIDED WITH THE SAME

(75) Inventors: Takayoshi Endo, Shizuoka (JP); Toshimasa Yoshigi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/662,315

(22) Filed: Sep. 14, 2000

(30) Foreign Application Priority Data

Sep. 17, 1999 (JP) ..... 11-263482

(51) Int. Cl.[7] ..... H01R 4/26; H01R 11/20

(52) U.S. Cl. ..... 439/397; 439/399; 439/407; 361/752

(58) Field of Search ..... 439/391–399, 439/421, 438–442, 492–93, 685–687, 843–45, 850–51, 839, 856, 865–68, 877–881, 42–49

(56) References Cited

U.S. PATENT DOCUMENTS 4,560,226 A * 12/1985 Dennis ..... 439/395
5,314,351 A * 5/1994 Yamamoto ..... 439/407
5,729,436 A * 3/1998 Yoshigi et al. ..... 361/752
5,908,326 A * 6/1999 Neuhauser et al. ..... 439/399
5,921,804 A * 7/1999 Nagai ..... 439/397
6,007,365 A * 12/1999 Atsumi et al. ..... 439/397
6,077,103 A * 6/2000 Saka et al. ..... 439/397
6,113,417 A * 9/2000 Furutani et al. ..... 439/397

FOREIGN PATENT DOCUMENTS

JP 04-337262 11/1992
JP 09-117038 5/1997

* cited by examiner

*Primary Examiner*—Tho D. Ta
*Assistant Examiner*—Larisa Tsukerman
(74) *Attorney, Agent, or Firm*—Armstrong, Westerman & Hattori, LLP

(57) ABSTRACT

A pair of forward caulking legs 28 and a pair of backward caulking legs 29 are provided at a forward and a backward positions of a press-contact part 27 of a terminal lug 21 so that an electric wire 24 is caulked by the forward and backward caulking legs 28, 29. A plurality of the terminal lugs 21 are arranged on a base plate 26, and the electric wire 24 is wired and arranged without interruption in the press-contact parts 27 respectively. The electric wire 24 between the adjacent terminal lugs 21 with respective terminal contact parts 30 opposed with each other is cut between the forward caulking legs 28.

3 Claims, 7 Drawing Sheets

TERMINAL LUG AND WIRING BOARD PROVIDED WITH THE SAME

BACKGROUND OF THE INVENTION

1. Field of the Invention

The present invention relates to an improved terminal lug which can electrically connect both electric wires and apparatuses such as an electromagnetic valve, etc. and a wiring board provided with the same.

2. Description of the Related Art

Conventionally, a female terminal lug of such a type as being adapted to receive a terminal of an electrical load such as an electromagnetic valve or the like and a wiring board provided with such female terminal lugs are disclosed in Japanese Publication No. 9-117038 of unexamined Patent Application. Referring to FIGS. 6 to 9, the female terminal lug of this type which is applied to an automatic gear box of a vehicle will be described. A female terminal lug 1 as shown in FIG. 8 is formed of a sheet metal by a press work, and comprises a boxlike solderless press-contact part 2 (hereinafter referred to as "press-contact part"), a pair of caulking legs 4 for caulking an electric wire 3 press-fitted in the press-contact part 2, and a terminal contact part 6 including a pair of curved springs 5 which are adapted to elastically contact with each other with contact pressure. The female terminal lug 1 is disposed at a determined position on a back side of a base plate 7 formed of an insulating material, as shown in FIG. 9.

The terminal contact part 6 is clearance-fitted into a recess 9 formed in a flat area 8 of the base plate 7. Meanwhile, the press-contact part 2 is seated on the flat area 8 as shown in FIG. 9. The electric wire 3 is wired through the female terminal lugs 1 which have been disposed at determined positions on the base plate 7 as seen in FIG. 7 by means of a wiring device which is well known means per se. In order to conduct the wiring work, the base plate 7 is turned upside down. The electric wire 3 is arranged in the press-contact parts 2 for an electric connection, and caulked by means of the caulking legs 4 to be fixed. Then, the electric wire 3 between the directly adjacent female terminal lugs 1, that is, between the respective press-contact parts 2 adjacent to each other is cut by means of a wire cutting die (a state of FIG. 7). Thereafter, a cover 10 is placed on the base plate 7 to constitute a wiring board 11, as shown in FIG. 9.

This wiring board 11 is contained in an oil pan 13 of an automatic gear box 12 as shown in FIG. 6. In this case, tab terminals 16 of a plurality of electromagnetic valves 14 for hydraulic pressure control (FIG. 7) arranged in the automatic gear box 12 or tab terminals 16 of connectors 15 at an end part of a wire harness (FIG. 7) are press-fitted into respective terminal contact parts 6 in a vertical direction with respect to the flat area 8. On this occasion, because each of the terminal contact parts 6 is clearance-fitted in the recess 9, a positional displacement between the tab terminal 16 and the terminal contact part 6 will be absorbed if any, while the terminal contact part 6 is relatively displaced within the recess 9. Thus, the tab terminal 16 is fitted in the terminal contact part 6 to be electrically connected.

The above described conventional female terminal lug 1 is provided with only one pair of the caulking legs 4 on one side of the press-contact part 2 and accordingly, the electric wire 3 will receive a stress pulled in a direction of an arrow B, when the electric wire 3 is cut at a position close to a press-contact edge 17 by means of the wire cutting die which will descend from a direction of an arrow A (FIG. 8). For this reason, the press-contact edge 17 will receive an irregular force, and there will be a fear that a force of the press-contact part 2 for holding the electric wire may be remarkably decreased, and reliability of the electrical connection may be lowered. In order to avoid such fears, the cutting work must be conducted carefully, which will require a long working time.

Further, the sheet metal work for integrally forming the female terminal lug 1 comprises steps of conducting a punching press, folding a press-contact plate 18 having the press-contact edge 17 with respect to a vertical wall 2', folding a flange 19 with respect to the press-contact plate 18, folding all of them with respect to a base part 1' to form the boxlike press-contact part 2, and caulking the flange 19 by means of a caulking hook 20. Therefore, a number of working steps are required, resulting in an increase of the cost. Furthermore, when the electric wire 3 is arranged in a crooked manner as shown by a mark C in FIG. 8, a counter action to a crooking deformation is always exerted on the press-contact edge 17 and the press-contact force for holding the electric wire will be weakened. Because it is difficult to arrange the electric wire in such a crooked manner and allowability of arranging the electric wire is restricted, there is a drawback that free arrangement of the electric wire, and accordingly, free design of arranging mechanical apparatuses such as the electromagnetic valve etc. will be also restricted.

The present invention has been made to overcome the above described problems, and its object is to provide a terminal lug and a wiring board provided with the same in which the holding force of the press-contact part with respect to an electric wire will not be decreased, and which can be manufactured at a low cost, and is free from restrictions in free arrangement of the electric wire and in free design of arrangement of mechanical apparatuses such as an electromagnetic valve, etc.

SUMMARY OF THE INVENTION

In order to solve the above described problems, there is proposed according to the invention, a terminal lug adapted to be mounted on a flat area of a base plate of an insulating material and having integrally a press-contact part to which an electric wire is press-fitted for an electrical connection, and a terminal contact part adapted to be clearance-fitted in a recess formed in the flat area and extended from the press-contact part to receive a terminal for an electric load, which comprises a pair of forward caulking legs and a pair of backward caulking legs provided at a backward and a forward positions of the press-contact part, whereby the electric wire press-fitted in the press-contact part is caulked by means of the forward and backward caulking legs.

According to a second aspect of the invention, the press-contact part is provided with a pair of folding pieces arranged in symmetrically opposed relation with each other, and the electric wire is press-fitted in a gap between a pair of the folding pieces for the electrical connection.

According to a third aspect of the invention, there is also provided a wiring board comprising a plurality of the terminal lugs according to the invention provided on the base plate, wherein the electric wire is wired and arranged in the press-contact parts without interruption, and the electric wire existing between the adjacent terminal lugs whose respective terminal contact parts are opposed with each other is cut between the forward caulking legs.

According to a fourth aspect of the invention, the electric wire existing between the adjacent terminal lugs whose respective terminal contact parts are opposed with each other is wired and arranged in a non-linear manner on the wiring board.

In the wiring board according to a fifth aspect of the invention, a terminal of an electromagnetic valve for controlling hydraulic pressure in an automatic gear box of a vehicle as an electric load is press-fitted into the terminal contact part.

In the wiring board according to a sixth aspect of the invention, terminals of rear combination lamps of a vehicle as an electric load are press-fitted into the terminal contact part.

DESCRIPTION OF THE PREFERRED EMBODIMENT

Figure 1:
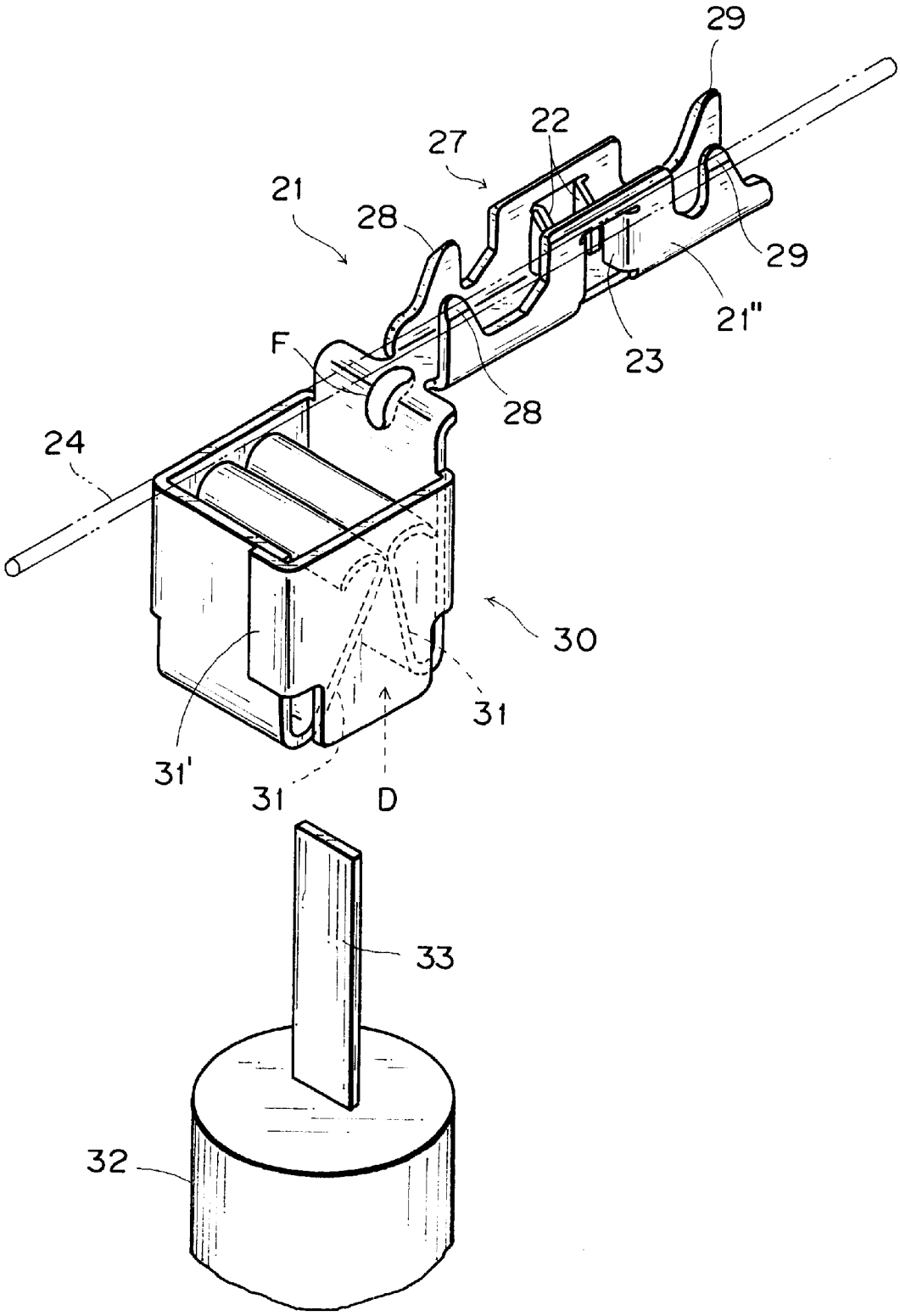
FIG. 1 is an enlarged perspective view of an outer appearance of a female terminal lug in an embodiment according to the present invention.
Figure 2:
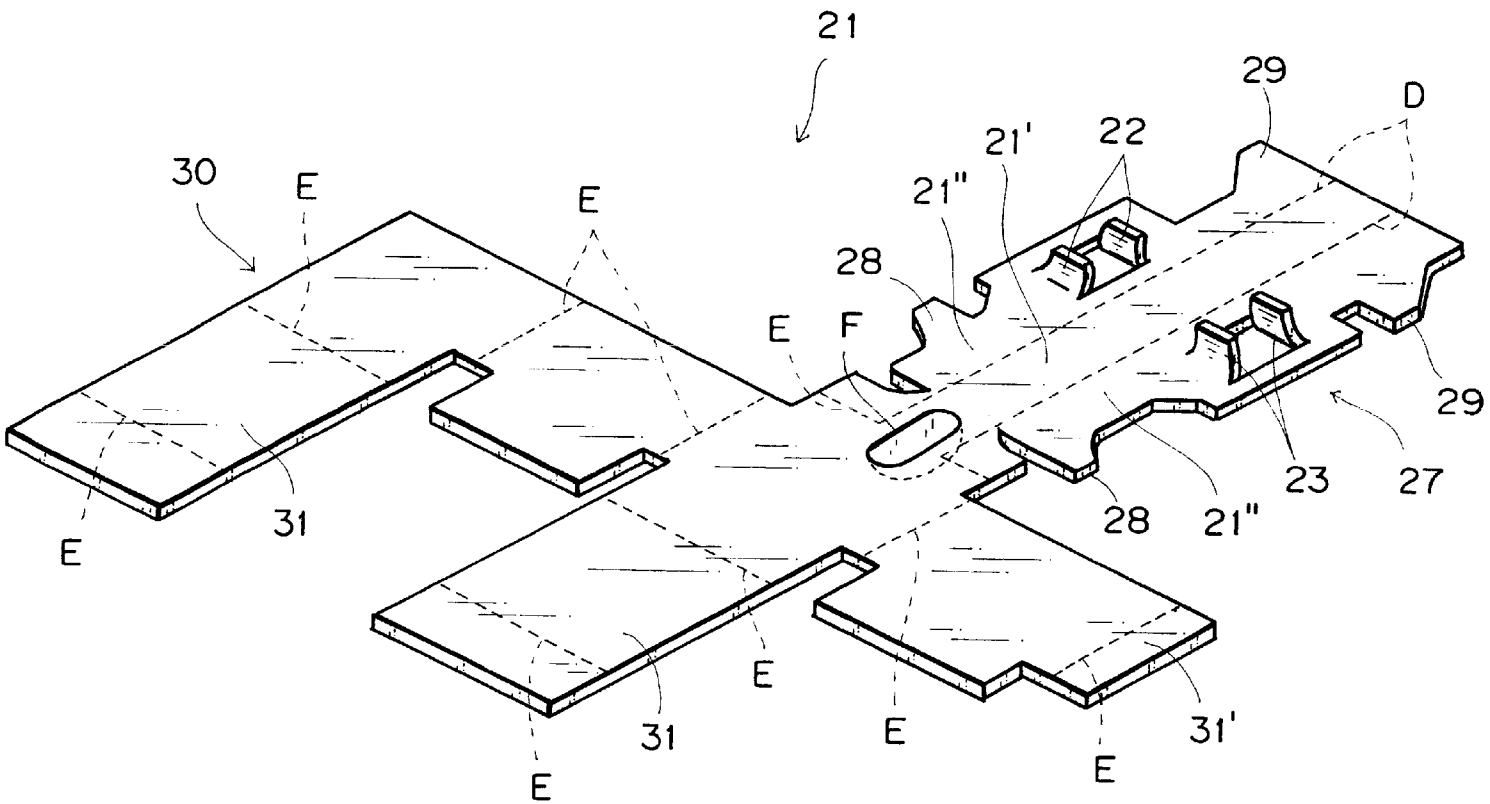
FIG. 2 is an explanatory developed view of the outer appearance showing a state of making the female terminal lug of FIG. 1 by a press work.

Now, an embodiment of a terminal lug according to the present invention will be described in detail referring to FIGS. 1 to 5. Numeral 21 is a female terminal lug, which is produced by folding, along dotted lines, a metal plate in FIG. 2 which has been formed of a metal sheet by a punching press work, for example. Thus, the female terminal lug 21 as shown in FIG. 1 can be obtained. A pair of folding pieces 22, 22, and a pair of folding pieces 23, 23 are formed in symmetrically opposed relation with each other on upright walls 22" which are uprightly formed when the base part 21' is folded along dotted lines D. When the metal plate in FIG. 2 is folded along the dotted lines D, the folding pieces 22 and 23 come close to each other to crease gaps therebetween having such a size as press-contacting an electric wire 24 as shown in FIG. 1. A press-contact part 27 to be mounted on a flat area 26' of a base plate 26 formed of an insulating material is produced in this way. A mark F designates a reinforcing indent which is formed during the press work.

The upright walls 21" on both sides of the press-contact part 27 are provided with a pair of forward caulking legs 28 and a pair of backward caulking legs 29. Both pairs of the caulking legs 28, 29 face with each other as shown in FIG. 1 when the upright walls 21" are foleded along the dotted lines D.

A terminal contact part 30 extends from the press-contact part 27 and is formed by folding the metal plate along a determined dotted lines E in FIG. 2. The terminal contact part 30 is formed in a closed shape in a horizontal section by means of an end portion 31' (FIG. 2). A pair of curved springs 31 are in an elastic contact with each other at their upper ends having contact pressure to be exerted on each other. A tab terminal 33 of an electromagnetic valve 32 inserted in a direction of an arrow D enters between the springs 31 against the contact pressure, thereby to attain the electric connection. The aforsaid closed shape in a horizontal section will prevent the contact pressure from being weakened. The terminal contact part 30 is designed to have such a size as being received with a slight play in a recess 34 which is formed in the flat area 26' of the base plate 26.

Figure 3:
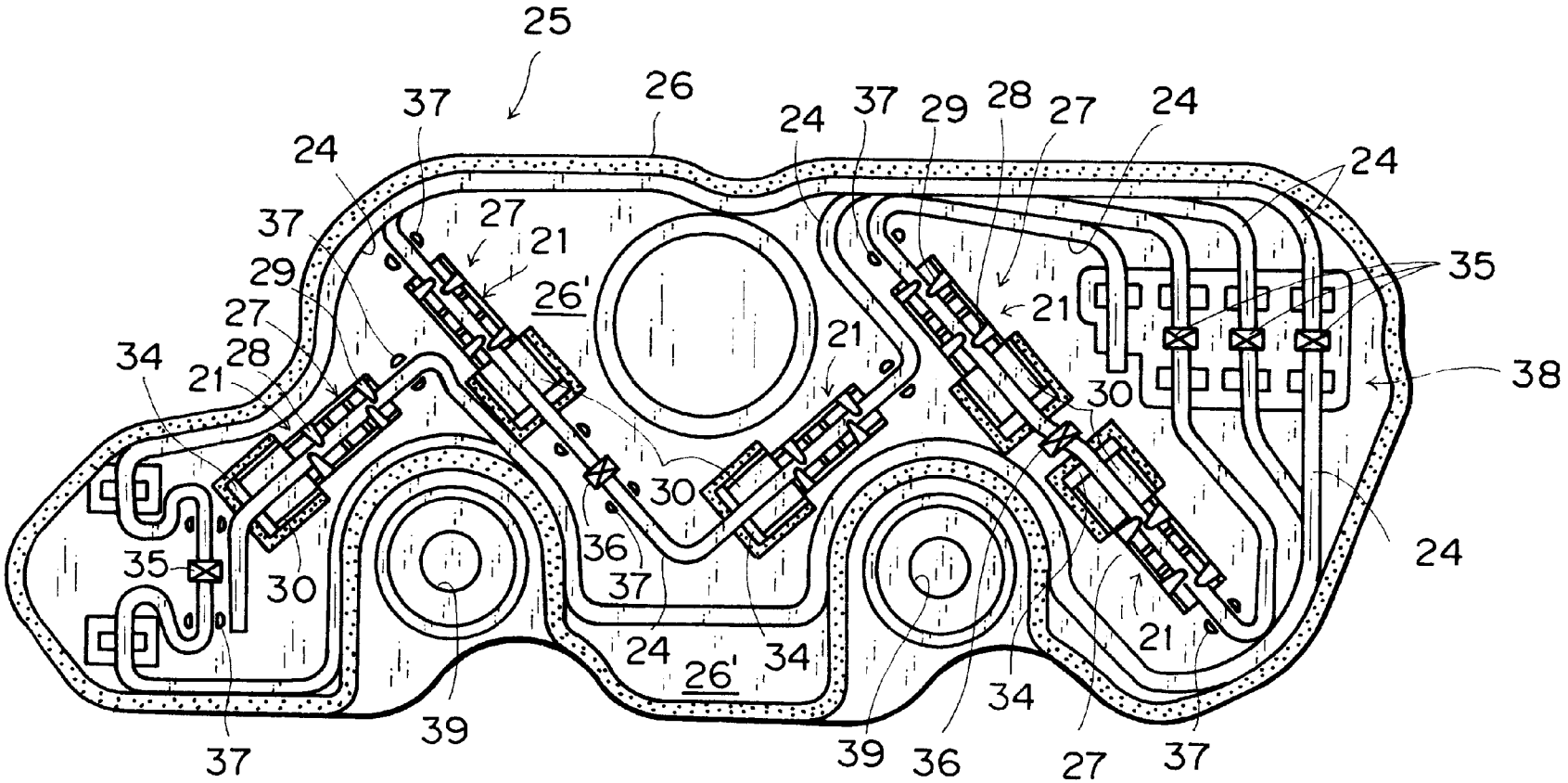
FIG. 3 is a plan view of a wiring board provided with the female terminal lugs according to the invention.

Now, a wiring board according to this invention provided with the female terminal lugs 21 which have been produced in this way will be described. The wiring board 25 comprises mainly the base plate 26, the female terminal lugs 21 and the electric wire 24 mounted on the base plate 26, and a cover 35 (FIG. 5) for covering the base plate 26. The base plate 26 is provided with the flat area 26' and a plurality of recesses 34 as described above. The female terminal lugs 21 are set with their terminal contact parts 30 received in the recesses (five) 34 as shown in FIG. 3. Then, the electric wire 24 is wired and arranged as shown in FIG. 3 snaking between the respective female terminal lugs 21 without interruption. At the same time, the electric wire 24 is press-contacted to the press-contact part 27 and caulked by means of the caulking legs 28, 29. Further, male press-contact terminals (not shown) for connecting rodlike press-contact terminals (not shown) at an end of a wire harness for a vehicle are press-fitted into determined fitting positions (seven) 38.

The electric wire 24 thus wired and arranged is electrically connected by being press-fitted into the press-contact part 27. Then, by caulking with both the caulking legs 28, 29, the electric wire 24 is fixed. In this state, the electric wire 24 is cut at six cutting positions 35, 36 by means of a wire cutting die which is not shown. Numeral 36 of the cutting positions designates two cutting positions at which the electric wire 24 is snaked or curved to be wired because the terminal contact parts 30 are arranged offset from each other or at a right angle.

Figure 4:
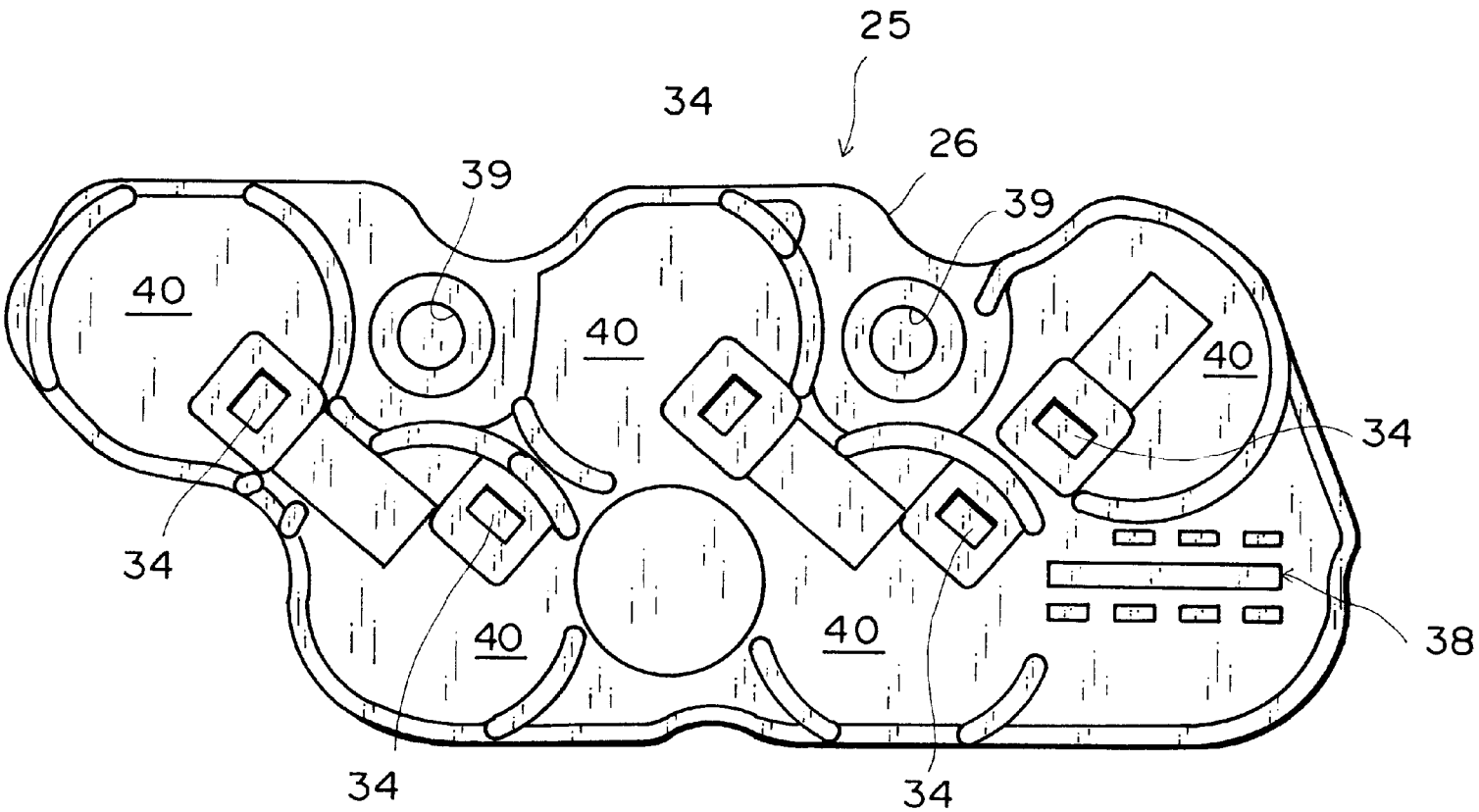
FIG. 4 is a rear view of the wiring board of FIG. 3 as seen from a back face.
Figure 5:
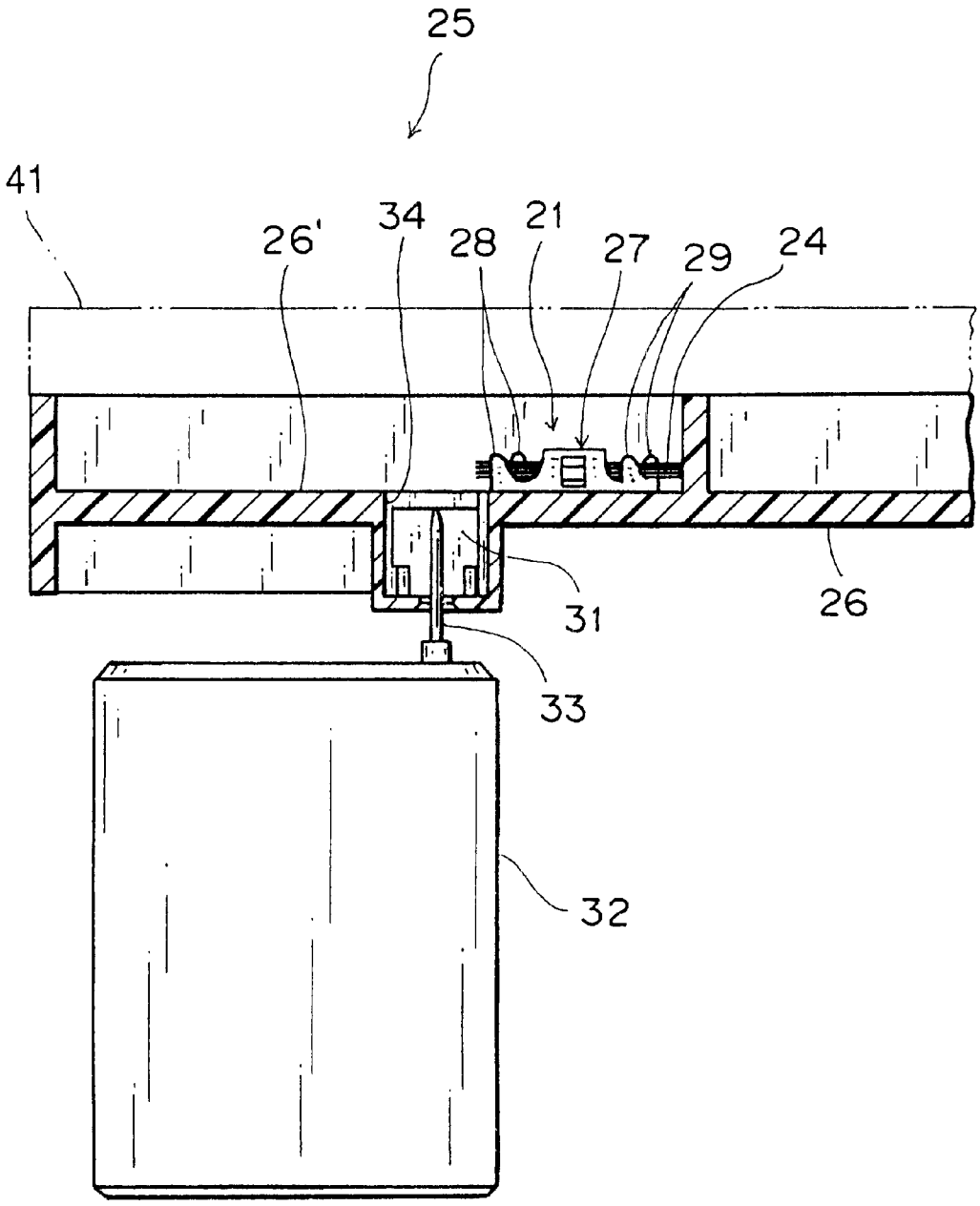
FIG. 5 is a longitudinal sectional view of the wiring board with the female terminal lugs fitted thereto.
Figure 6:
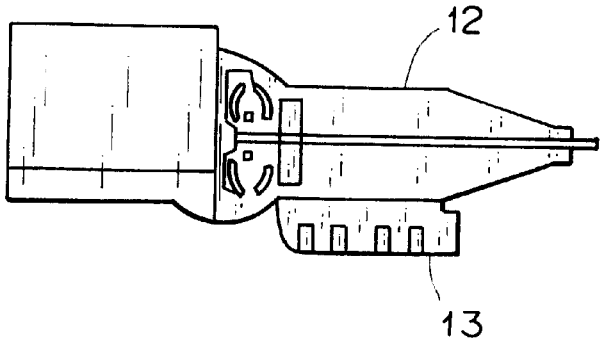
FIG. 6 is a schematic view of an automatic gear box of a vehicle.
Figure 7:
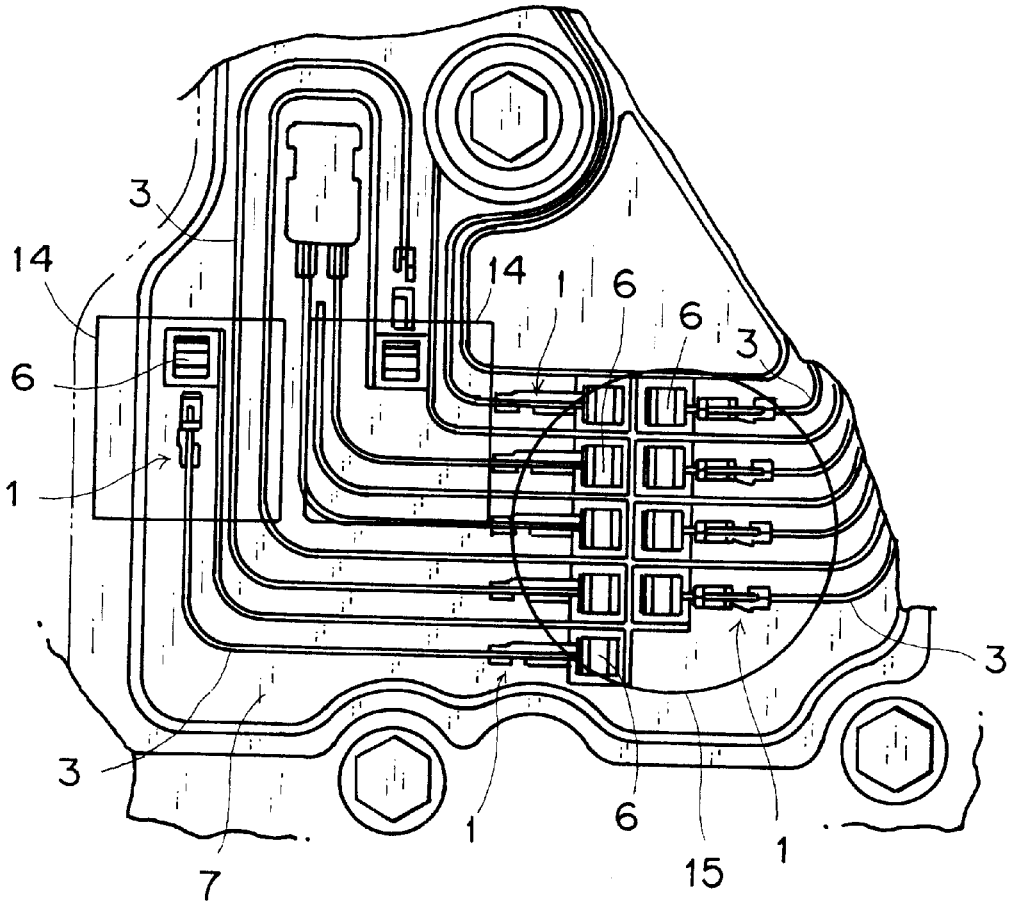
FIG. 7 PRIOR ART
FIG. 7 is a plan view showing a relative arrangement of a base plate, female terminal lugs and electric wires in a conventional case.
Figure 8:
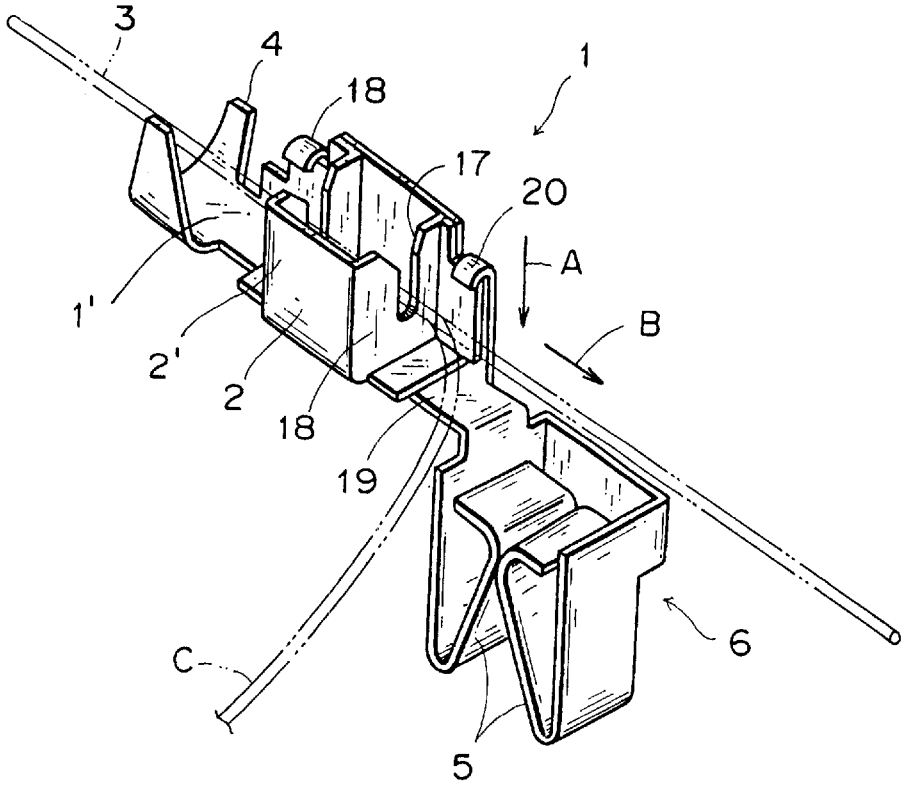
FIG. 8 PRIOR ART
FIG. 8 is an enlarged perspective view of an outer appearance of a female terminal lug employed in FIG. 7.
Figure 9:
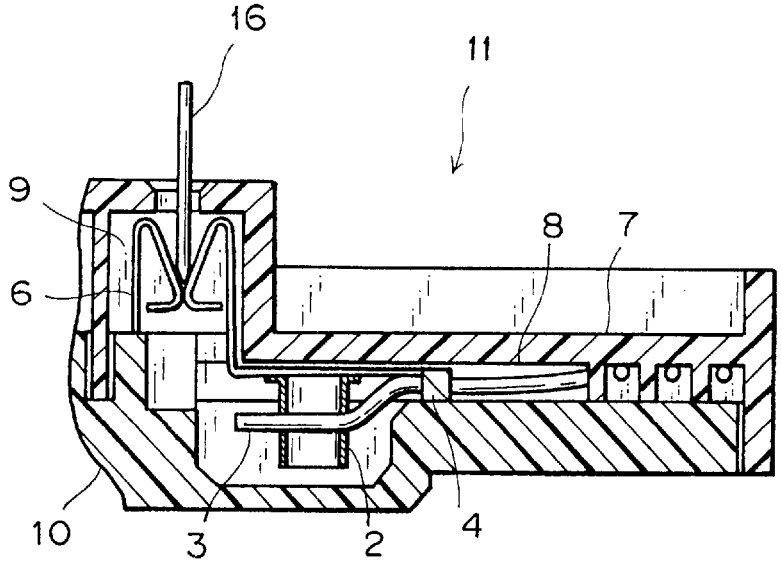
FIG. 9 PRIOR ART
FIG. 9 is a longitudinal sectional view of a part of the wiring board containing the female terminal lug of FIG. 8 in an enlarged scale.

In FIG. 3, numeral 37 designates ribs for press-fitting and positioning the electric wire to be arranged, and numeral 39 designates insertion holes for bolts for fixing the cover 35. On a back face of the base plate 26 as shown in FIG. 4, are formed contact parts (five) 40 in which actuators 32 such as an electromagnetic valve, etc. as electric loads are adapted to be set at positions corresponding to the terminal contact parts 30 of the respective female terminal lugs 21.

After the female terminal lugs 21 have been set on the base plate 26, the electric wire 24 has been wired and arranged, and then, press-contacted and caulked, and the electric wire 24 has been cut at the determined positions 35, 36, the cover 41 is placed on the base plate 26 to tightly close it. Thus, the wiring board 25 is completed. When mounting this wiring board 25 on the automatic gear box, the actuators (the electromagnetic valve, etc.) can be fitted to the wiring board 25 by inserting the tabs 33 of the actuators 32 into the terminal contact parts 30.

With the female terminal lug 21 according to the invention, the electric wire 24 is caulked by means of not only the backward caulking legs 29 but also the forward caulking legs 28, and accordingly, even in case of cutting the electric wire 24 extending forward of the press-contact part 27, the stress exerted on the electric wire can be restrained thereby to prevent the holding force of the electric wire in the press-contact part 27 from being weakened. Therefore, relaiability of the electrical connection can be maintained.

Moreover, the female terminal lug 21 is produced through less working steps as compared with the female terminal lug 1 in the conventional case, which will make it advantageous in respect of a low production cost.

Further, according to the wiring board 25 provided with the female terminal lug 21 as well as the female terminal lug 21 itself, the electric wire 24 is caulked by means of the forward caulking legs 28. Accordingly, even though the electric wire is wired in a non-linear manner, a counter force due to bending deformation of the electric wire will be restrained from being exerted on the press-contact part, and allowability of wiring the electric wire can be increased. As the results, allowability of mounting of the female terminal lugs, that is, wiring of the electric wire will not be restricted. Therefore, it is advantageous that the actuator can be easily fitted to the base plate 26, even though the position to mount the actuator is changed due to a change in hydraulic piping arrangement in the automatic gear box.

Still further, because the terminal contact part 30 is formed in a closed structure in a sectional view by means of the end portion 31', the tab terminal 33 of any size can be held in a good condition without decreasing the contact pressure. This is advantageous in respect that the reliability of the electrical connection can be maintained.

Instead of the tab terminal 33 of the electromagnetic valve for controlling the hydraulic pressure in the gear box, terminals of rear combination lamps of a vehicle can be connected to the terminal contact part 30.

Although the present invention has been fully described by way of examples with reference to the accompanying drawings, it is to be noted that various changes and modifications will be apparent to those skilled int the art. Therefore, unless otherwise such changes and modifications depart from the scope of the present invention, they should be construed as being included therein.

For example, although the invention has been described referring to the female terminal lug 21, the invention may include a male terminal lug. The press-contact part 27 is provided with the two pairs of the folding pieces 22, 23 in the described embodiment, but a pair or three pairs of the folding pieces may be provided.

Further, any type of the electric wire 24 such as a solid wire, a strand wire, etc, can be employed.

What is claimed is:

1. A wiring board comprising a plurality of terminal lugs, each said lug adapted to be mounted on a flat area of a base plate of an insulating material and having integrally a press-contact part to which an electric wire is press-fitted in a recess formed in said flat area and extended from said press-contact part to receive a terminal for an electric load, which comprises:

a pair of forward caulking legs and a pair of backward caulking legs provided in a backward and a forward position of said press-contact part, whereby said electric wire press-fitted in said press-contact part, is caulked by means of said forward and backward caulking legs; and said electric wire is wired and arranged in each said press-contact part without interruption, and said electric wire existing between adjacent terminal lugs whose respective terminal contact parts are opposed with each other is cut between said forward caulking legs;

wherein said electric wire existing between the adjacent terminal lugs whose respective terminal contact parts are opposed with each other is wired and arranged in a non-linear manner.

2. The wiring board as claiming in claim 1, wherein a terminal of an electromagnetic valve for controlling hydraulic pressure in an automatic gear box of a vehicle as the electric load is press-fitted into said terminal contact part.

3. The wiring board as claimed in claim 1, wherein terminals of rear combination lamps of a vehicle as the electric load are press-fitted into said terminal contact part.

* * * * *